United States Patent [19]

Picone et al.

[11] Patent Number: 4,879,748

[45] Date of Patent: Nov. 7, 1989

[54] PARALLEL PROCESSING PITCH DETECTOR

[75] Inventors: Joseph Picone, Forest Park; Dimitrios Prezas, Park Ridge, both of Ill.

[73] Assignees: American Telephone and Telegraph Company, New York, N.Y.; AT&T Bell Laboratories, Murray Hill, N.J.

[21] Appl. No.: 770,633

[22] Filed: Aug. 28, 1985

[51] Int. Cl.[4] ..... G10L 7/02

[52] U.S. Cl. ..... 381/49

[58] Field of Search ..... 381/49, 38, 29-50; 364/513.5

[56] References Cited

U.S. PATENT DOCUMENTS

| | | | |
|---|---|---|---|
| 3,496,465 | 2/1970 | Schroeder | 381/49 |
| 3,617,636 | 11/1971 | Ogihara | 381/49 |
| 3,740,476 | 6/1973 | Atal | 381/49 |
| 3,852,535 | 12/1974 | Zurcher | 381/49 |
| 3,903,366 | 9/1975 | Coulter | 381/38 |
| 3,916,105 | 10/1975 | McCray | 381/49 |
| 3,979,557 | 9/1976 | Schulman et al. | 381/49 |
| 4,004,096 | 1/1977 | Bauer et al. | 381/49 |
| 4,058,676 | 11/1977 | Wilkes et al. | 381/29 |
| 4,301,329 | 11/1981 | Taguchi | 381/37 |
| 4,360,708 | 11/1982 | Taguchi et al. | 381/36 |
| 4,561,102 | 12/1985 | Prezas | 381/49 |
| 4,653,098 | 3/1987 | Nakata et al. | 381/49 |

OTHER PUBLICATIONS

Holm, "Automatic Generation of Mixed Excitation in a Linear Predictive-Speech Synthesizer", IEEE ICASSP '81, pp. 118-120.

Areseki et al., "Multi-Pulse Excited Speech Coder . . . ", IEEE GLOBECOM '83, pp. 23.3.1-23.3.5.

Copperi et al., "Vector Quantization and Perceptual Criteria for Low Rate Coding of Speech", IEEE ICASSP '85, pp. 7.6.1-7.6.4.

Markel, "A Linear Prediction Vocoder Simulation . . . ", IEEE Trans. ASSP, vol. ASSP-22, No. 2, Apr. 1974, pp. 124-134.

Un et al., "A Pitch Extraction Algorithm Based on LPC Inverse Filtering and AMDF," IEEE Trans. ASSP, vol. ASSP-25, No. 6, 12/77, pp. 565-572.

Malpass, "The Gold Rabiner Pitch Detector in a Real Time Environment", IEEE EASCON '75, pp. 31-A-3-1-G.

Wong, "On Understanding the Quality Problems of LPC Speech", IEEE ICASSP '80, pp. 725-728.

Alexander, "A Simple Noniterative Speech Excitation Algorithm Using the LPC Residual", IEEE ASSP, vol. ASSP-33, No. 2, 4/85, 432-434.

(List continued on next page.)

*Primary Examiner*—Gary V. Harkcom
*Assistant Examiner*—John Merecki
*Attorney, Agent, or Firm*—John C. Moran

[57] ABSTRACT

A pitch detector system for use with speech analysis and synthesis methods having a plurality of identical detectors each responsive to a different portion of a speech signal for estimating a pitch value and a voter circuit responsive to the estimated pitch values for determining a final pitch value. The pitch detectors are identical in design which allows for an efficient software implementation since only one set of program instructions is necessary to implement all of the encoders. The voter subsystem may be implemented by a digital signal processor executing program instructions that calculate a pitch value from the estimated pitch values determined by the pitch detectors and a second set of program instructions for constraining the final pitch value outputted by the voter subsystem so that the calculated pitch value is in agreement with calculated pitch values for previous frames. In addition, the pitch and voters may be implemented by a third set of program instructions executing on the same digital signal processor as the sets of instructions for the voter subsystem.

13 Claims, 3 Drawing Sheets

OTHER PUBLICATIONS

Un et al., "A 4800 BPS LPC Vocoder with Improved Excitation", IEEE ICASSP '80, pp. 142–145.

"Improving Performance of Multipulse LPC Coders at Low Bit Rates", B. Atal and S. Singhal, *ICASSP* '84, pp. 1.3–1.4.

"A New Model of LPC Excitation for Producing Natural-Sounding Speech at Low Bit Rates", B. Atal and J. Remde, *ICASSP* '82, pp. 614–617.

"An Integrated Pitch Tracking Algorithm for Speech Systems", B. G. Secrest and G. R. Doddington, in *Proc. 1983, Int. Conf. Acoust., Speech, Signal Processing,* pp. 1352–1355, Apr., 1983.

"Postprocessing Techniques for Voice Pitch Trackers", B. G. Screst and G. R. Doddington, in *Proc. 1982 IEEE Int. Conf. Acoust., Speech, Signal Processing,* pp. 172–175, Apr., 1982.

"A Procedure for Using Pattern Classification Techniques to Obtain a Voiced/Unvoiced Classifier", L. J. Siegel, *IEEE Transactions on Acoustics, Speech, and Signal Processing,* vol. ASSP-27, No. 1, pp. 83–89, Feb., 1979.

"Parallel Processing Techniques for Estimating Pitch Periods of Speech in the Time Domain", B. Gold and L. R. Rabiner, *The Journal of the Acoustical Society of America,* vol. 46, No. 2, pp. 442–448, 1969.

PARALLEL PROCESSING PITCH DETECTOR

CROSS-REFERENCE TO RELATED APPLICATIONS

Concurrently filed herewith and assigned to the same assignee as this application are:

W. T. Hartwell, et al., "Digital Speech Coder With Different Excitation Types", Ser. No. 770,632; and D. Prezas, et al., "Voice Synthesis Utilizing Multi-Level Filter Excitation", Ser. No. 770,631.

1. Technical Field

This invention relates generally to digital coding of human speech signals for compact storage and subsequent synthesis and, more particularly, to pitch detection and the simultaneous determination of the voiced and unvoiced characterization of discrete frames of speech.

2. Background of the Invention

In order to reduce the bandwidth necessary to transmit human speech, it is known to digitize the human speech and then to encode the speech so as to minimize the number of digital bits per second required to store the coded digitized speech for acceptable quality of speech reproduction after the information has been transmitted and decoded for speech reproduction. Analog speech samples are customarily partitioned into frames or segments of discrete lengths on the order of 20 milliseconds in duration. Sampling is typically performed at a rate of 8 kilohertz (kHz) and each sample is encoded into a multibit digital number. Successive coded samples are further processed in a linear predictive coder (LPC) that determines appropriate filter parameters which model the human vocal tract. Each filter parameter can be used to estimate present values of each signal sampled efficiently on the basis of the weighted sum of a preselected number of prior sample values. The filter parameters model the formant structure of the vocal tract transfer function. The speech signal is regarded analytically as being composed of an excitation signal and a formant transfer function. The excitation component arises in the larynx or voice box and the formant component results from the operation of the remainder of the vocal tract on the excitation component. The excitation component is further classified as voiced or unvoiced, depending upon whether or not there is a fundamental frequency imparted to the air stream by the vocal cords. If there is a fundamental frequency imparted to the air stream by the vocal cords, then the excitation component is classed as voiced. If the excitation is unvoiced, then the excitation component is simply white noise.

To encode the speech for low bit rate transmission, it is necessary to determine the LPC parameters, also referred to as coefficients, for segments of speech and transfer these coefficients to the decoding circuit which is reproducing the speech. In addition, it is necessary to determine the excitation component. First, it must be determined whether this component is to be classed as voiced or unvoiced; and if the classification is voiced, then it is necessary to determine the fundamental frequency imparted to the air stream by the vocal cords. A number of methods exist for determining the LPC coefficients. The problem of determining the fundamental frequency, or as it is commonly referred to, pitch detection, is more difficult.

One prior art method of pitch detection is based primarily on an important property of speech which is the long term regularity of the speech waveform. Ideally, voiced speech can be viewed as a periodic signal consisting of a fundamental frequency component and its harmonics. Therefore, the output of a low-pass filter that cuts off at a frequency less than the second harmonic should be appear as a sine wave with frequency equal to the pitch. That frequency then is determined utilizing amplitude detection circuitry. This method suffers from the fact that actual speech deviates from this model during the transition regions of speech disturbing the regularity. In addition, the pitch period itself may vary depending upon whether the speaker is a male or a female.

The problems of pitch detection can be enhanced under some conditions by removing the formant structure of the speech which is also referred to as spectrum flattening. The spectrum flattening can be done utilizing Fourier transform or linear predictive analysis. The use of an LPC filter to flatten the spectrum is also referred to as inverse filtering to subtract the formant structure from the speech signal. Such a system is disclosed in U.S. Pat. No. 3,740,476, issued June 19, 1973, to B. S. Atal. The resultant residual wave that results from the LPC filtering approximates the excitation function of the vocal tract, and pulse amplitude techniques can be utilized to extract the pitch from this information. This technique fails, however, when the harmonics of the excitation fall under the formants of the speech signal in the frequency domain. When this occurs, the excitation information normally found in the residual wave is removed by the LPC inverse filtering. The result is that the residual signal then looks noisy and the pitch pulses are not easily detected.

Another prior art method of pitch detection is disclosed in the article entitled, "Parallel Processing Techniques for Estimating Pitch Periods of Speech in the Time Domain", B. Gold and L. Rabiner, *The Journal of the Acoustical Society of America,* Vol. 36, No. 2 (part 2), 1969. This article discloses the use of parallel pitch detectors where each of the pitch detectors is responsive to the analog voice signal to determine individually a pitch estimate. After these estimations of the pitch have been performed, a matrix is constructed of the pitch estimates; and an algorithm is utilized to determine a "correct" pitch. This method experiences problems in detecting the pitch during transitional regions of speech since the method performs all pitch estimations on the original speech signal. In addition, the algorithm utilized to make the determination of the "correct" pitch is concerned, to a large extent, with differentiating between the pitch fundamental and the second and third harmonics.

SUMMARY OF THE INVENTION

An illustrative pitch detector system and method utilizing a plurality of detectors each responsive to a different portion of the speech signal for estimating a pitch value, another plurality of detectors each responsive to a different portion of a residual signal calculated from the speech signal, and a voter responsive to the estimated pitch values for determining a final pitch value. The detectors are identical in design which allows an efficient software implementation since only one type of encoder is necessary to implement all of the encoders.

The structural embodiment comprises a sample and quantizer circuit that is responsive to human speech to digitize and quantize the speech. A digital signal processor is responsive to a first set of program instructions for storing a predetermined number of the digitized samples as a speech frame, responsive to a second set of program instructions and the digitized speech samples to generate residual samples of the digitized speech samples that remain after the formant effect of the vocal tract has been substantially removed, responsive to a third set of program instructions and individual predetermined portions of the speech samples for estimating pitch values, responsive to a fourth set of program instructions and the residual samples for estimating pitch values, and responsive to a fifth set of program instructions for determining a final pitch value of said speech frames from the estimated pitch values.

Advantageously, the fifth set of program instructions comprises a first subset of program instructions for calculating a pitch value from the estimated pitch values of the second set of program instruction sets and a second subset of program instructions for constraining the final pitch value so that the calculated pitch value is in agreement with the calculated pitch values from previous frames.

In addition, an unvoiced speech frame is indicated by the calculated pitch value being equal to a predefined value which, advantageously, may be zero; and voiced frames are indicated by the calculated pitch value not being equal to the predefined value. The second subset of program instructions further consists of a first group of instructions responsive to a first sequence consisting of voiced, unvoiced, and voiced frames for generating a new calculated pitch value indicating a voiced frame. A second group of instructions responsive to a second sequence consisting of unvoiced, voiced, and unvoiced frames for generating a new calculated value indicating an unvoiced frame. A third group of instructions responsive to a third sequence consisting of voiced, voiced, and voiced frames for generating a new calculated pitch value having an arithmetic relationship to the calculated pitch values of the frames of said third sequence.

Further, the first group of instructions of the second subset is responsive to the first sequence of frames for setting the calculated pitch value equal to the arithmetic average of the calculated pitch values of the voiced frames of the first sequence, and the second group of instructions is responsive to the second sequence of frames for setting the new calculated pitch value to said predefined value.

Also, the second subset of instructions further comprises a fourth group of instructions that are responsive to a fourth sequence consisting of voiced, voiced, and unvoiced frames to calculate a new pitch value equal to the average of the calculated pitch values for the voiced and voiced frames upon the difference between the two voiced frames being less than another predefined value. If the difference between the pitch values for the two voiced frames is greater than the other predefined value, then the new calculated pitch value is set equal to the pitch value of the earlier voiced frame.

In addition, the first subset of program instructions comprises a first group of instructions responsive to all but a subset of the estimated pitch values equaling the predefined value for setting the calculated pitch value equal to the arithmetic average of the subset of value upon the estimated pitch values of the subset of values differing by less than another predefined value from each other. Further, the first group of instructions is responsive to all of the estimated pitch values being equal to the predefined value except for a subset of pitch values for setting the calculated pitch value equal to the predefined value upon the difference between each of the pitch values of the subset being greater than the other predefined value.

Also, the first subset of instructions comprises a second group of instructions responsive to all of the estimated pitch values except one equaling the predefined value for setting the calculated pitch value equal to the estimated pitch value not equal to the predefined value.

Also, the fourth set of program instructions used to estimate pitch values has a first subset of instructions for locating the sample of maximum amplitude within the predetermined portion of the residual samples within the frame. A second subset of instructions locates subsequent maximum samples, also termed candidate samples, in the frame of lesser amplitude than that of the maximum amplitude sample spaced by not less than a minimum distance based on the highest expected fundamental speech frequency from the maximum amplitude sample and each of the other samples within the frame. A third subset of instructions measures one by one the distance between adjacent located candidate samples using as a reference the maximum amplitude sample. A fourth subset of instructions tests for periodicity by comparing successive distance measurements for substantial equality and rejecting candidate samples that are not periodically related to the maximum amplitude sample. A fifth subset of instruction determines the estimated pitch value by calculating the quotient of the distance between extreme valid candidate samples within this speech frame. Finally, a sixth subset of instruction designates whether the frame is voiced or unvoiced. If the frame is unvoiced, the estimated pitch value is set equal to the predefined value, which advantageously may be zero, to indicate an unvoiced frame.

The illustrative method functions in a system having a quantizer and a digitizer for converting analog speech into frames of digital samples and a digital signal processor that is executing a plurality of program instructions for determining the pitch of a particular frame of digital speech. The signal processor determines the pitch by executing the steps of producing residual samples of the digitized speech that remain after the formant effect of the vocal tract has been substantially removed, estimating a first pitch value of the present speech frame from positive ones of the digitized speech samples, estimating a second pitch value from negative ones of the digitized speech samples, estimating a third value from positive ones of the residual samples, estimating a fourth pitch value from negative ones of the residual samples, and determining a final pitch value for a previous speech frame on the basis of the estimated pitch values determined by the estimating steps for a plurality of previous speech frames.

Advantageously, the step of determining the final pitch value is performed by the digital signal processor responding to subsets of programmed instructions to performing the steps of calculating the final pitch value from the first, second, third, and fourth pitch values previously estimated and constraining the final pitch value so that the final pitch value is in agreement with the final pitch values from previous frames as previously determined by the digital signal processor.

DETAILED DESCRIPTION

Figure 1:
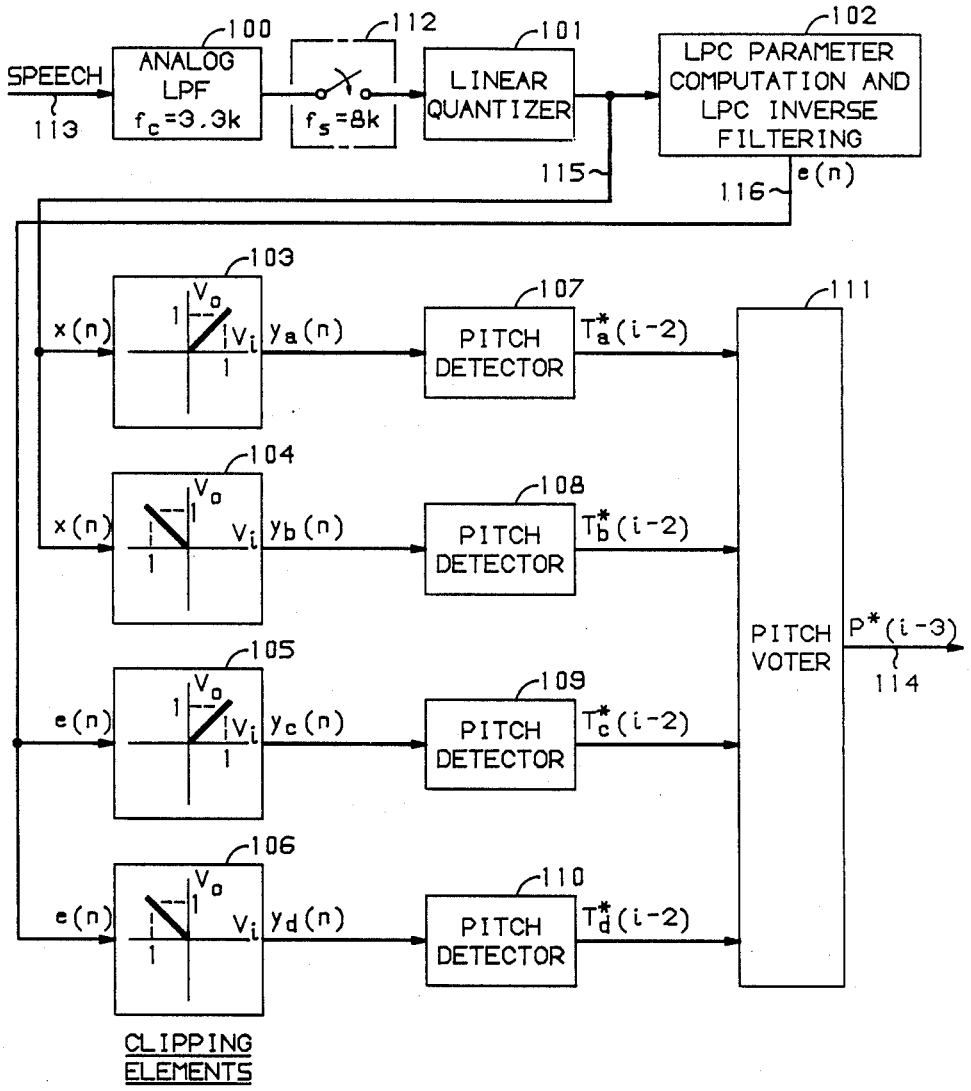
FIG. 1 illustrates, in block diagram form, a pitch detector in accordance with this invention.

FIG. 1 shows an illustrative pitch detector which is the focus of this invention. The pitch detector is responsive to analog speech signals received via conductor 113 to indicate on output bus 114 whether the speech excitation is voiced or unvoiced and, if voiced, to indicate the pitch. The latter determinations are performed by pitch voter 111 in response to the outputs of pitch detectors 107 through 110. In order to reduce aliasing, the input speech on conductor 113 is filtered by filter 100 which, advantageously, may be an eighth-order Butterworth analog low-pass filter whose −3 dB frequency is 3.3 kHz. The filtered speech is then digitized and quantized by sampler 112 and linear quantizer 101. The latter transmits the digitized speech, x(n), to clippers 103 and 104 and to LPC coder and inverse filter 102. The output of coder and filter 102 is the residual signal from the inverse filtering that is transmitted to clippers 105 and 106 via path 116. Coder and filter 102 first performs the computations required to determine the filter coefficients that are used by the LPC inverse filter and then uses these filter coefficients to perform the inverse filtering of the digitized voice signal in order to calculate the residual signal, e(n). This is done in the following manner. The digitized speech x(n) is divided into, advantageously, 20 millisecond frames during which it is assumed that the all pole LPC filter is time-invariant. The frame of digitized speech is used to compute a set of reflection coefficients which, advantageously, may be 10, using the lattice computation method. The resulting tenth order inverse lattice filter generates the forwarded prediction error or residual as well as providing the reflection coefficients. The clippers 103 through 106 transform the incoming x and e digitized signals on paths 115 and 116, respectively, into positive-going and negative-going wave forms. The purpose for forming these signals is that whereas the composite waveform might not clearly indicate periodicity the clipped signal might. Hence, the periodicity is easier to detect. Clippers 103 and 105 transform the x and e signals, respectively, into positive-going signals and clippers 104 and 106 transform the x and e signals, respectively, into negative-going signals.

Pitch detectors 107 through 110 are each responsive to their own individual input signals to make a determination of the periodicity of the incoming signal. The output of the pitch detectors occurs two frames after receipt of those signals. Note, that each frame consists of, illustratively, 160 sample points. Pitch voter 111 is responsive to the output of the four pitch detectors to make a determination of the final pitch. The output of pitch voter 111 is transmitted via path 114.

Figure 2:
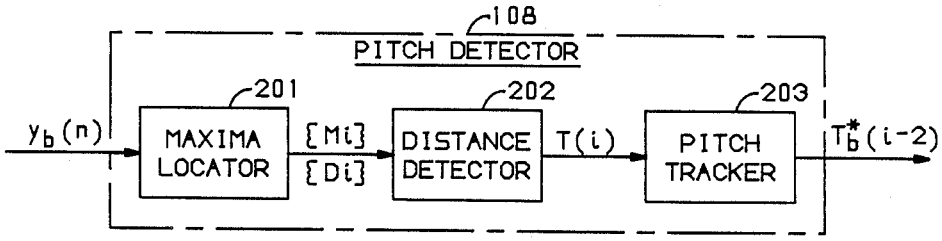
FIG. 2 illustrates, in block diagram form, pitch detector 108 of FIG. 1.

FIG. 2 illustrates in block diagram form, pitch detector 108. The other pitch detectors are similar in design. The maxima locator 201 is responsive to the digitized signals of each frame for finding the pulses on which the periodicity check is performed. The output of maxima locator 201 is two sets of numbers: those representing the maximum amplitudes, $M_i$, which are the candidate samples, and those representing the location within the frame of these amplitudes, $D_i$. Distance detector 202 is responsive to these two sets of numbers to determine a subset of candidate pulses that are periodic. This subset represents distance detector 202's determination of what the periodicity is for this frame. The output of distance detector 202 is transferred to pitch tracker 203. The purpose of pitch tracker 203 is to constrain the pitch detector's determination of the pitch between successive frames of digitized signals. In order to perform this function, pitch tracker 203 uses the pitch as determined for the two previous frames.

Consider now in greater detail, the operations performed by maxima locator 201. Maxima locator 201 first identifies within the samples from the frame, the global maxima amplitude, $M_0$, and its location, $D_0$, in the frame. The other points selected for the periodicity check must satisfy all of the following conditions. First, the pulses must be a local maxima, which means that the next pulse picked must be the maximum amplitude in the frame excluding all pulses that have already been picked or eliminated. This condition is applied since it is assumed that pitch pulses usually have higher amplitudes than other samples in a frame. Second, the amplitude of the pulse selected must be greater than or equal to a certain percentage of the global maximum, $M_i > gM_0$, where g is a threshold amplitude percentage that, advantageously, may be 25%. Third, the pulse must be advantageously separated by at least 18 samples from all the pulses that have already been located. This condition is based on the assumption that the highest pitch encountered in human speech is approximately 440 Hz which at a sample rate of 8 kHz results in 18 samples.

Distance detector 202 operates in a recursive-type procedure that begins by considering the distance from the frame global maximum, $M_0$, to the closest adjacent candidate pulse. This distance is called a candidate distance, $d_c$, and is given by $$d_c = |D_0 - D_i|$$

where $D_i$ is the in-frame location of the closest adjacent candidate pulse. If such a subset of pulses in the frame are not separated by this distance, plus or minus a breathing space, B, then this candidate distance is discarded, and the process begins again with the next closest adjacent candidate pulse using a new candidate distance. Advantageously, B may have a value of 4 to 7. This new candidate distance is the distance to the next adjacent pulse to the global maximum pulse.

Figure 3:
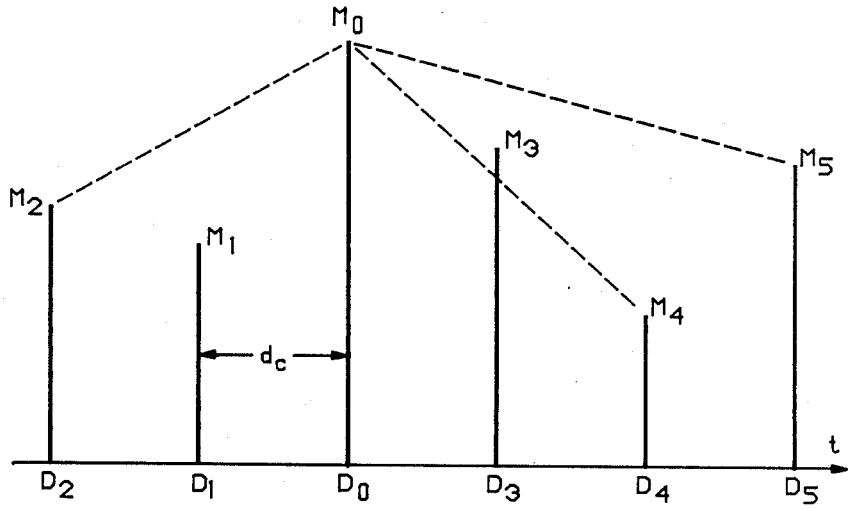
FIG. 3 illustrates, in graphic form the candidate samples of a speech frame.

Once pitch detector 202 has determined a subset of candidate pulses separated by a distance, $d_c \pm B$, an interpolation amplitude test is applied. The interpolation amplitude test performs linear interpolation between $M_0$ and each of the next adjacent candidate pulses, and requires that the amplitude of the candidate pulse immediately adjacent to $M_0$ is at least q percent of these interpolated values. Advantageously, the interpolation amplitude threshold, q percent, is 75%. Consider the example illustrated by the candidate pulses shown in FIG. 3. For $d_c$ to be a valid candidate distance, the following must be true:

$$M_1 > q\left[M_2 + \frac{M_0 - M_2}{|D_0 - D_2|}|D_1 - D_2|\right],$$

$$M_3 > q\left[M_4 + \frac{M_0 - M_4}{|D_0 - D_4|}|D_3 - D_4|\right],$$

and $$M_3 > q\left[M_5 + \frac{M_0 - M_5}{|D_0 - D_5|}|D_3 - D_5|\right],$$

where $$d_c = |D_0 - D_1| > 18.$$

As noted previously, $$M_i > gM_0, \text{ for } i = 1,2,3,4,5.$$

Pitch tracker 203 is responsive to the output of distance detector 202 to evaluate the pitch distance estimate which relates to the frequency of the pitch since the pitch distance represents the period of the pitch. Pitch tracker 203's function is to constrain the pitch distance estimates to be consistent from frame to frame by modifying, if necessary, any initial pitch distance estimates received from the pitch detector by performing four tests: voice segment start-up test, maximum breathing and pitch doubling test, limiting test, and abrupt change test. The first of these tests, the voice segment start-up test is performed to assure the pitch distance consistency at the start of a voiced region. Since this test is only concerned with the start of the voiced region, it assumes that the present frame has non-zero pitch period. The assumption is that the preceding frame and the present frame are the first and second voice frames in a voiced region. If the pitch distance estimate is designated by T(i) where i designates the present pitch distance estimate from distance detector 202, the pitch detector 203 outputs T*(i−2) since there is a delay of two frames through each detector. The test is only performed if T(i−3) and T(i−2) are zero or if T(i−3) and T(i−4) are zero while T(i−2) is non-zero, implying that frames i−2 and i−1 are the first and second voiced frames, respectively, in a voiced region.

The voice segment start-up test performs two consistency tests: one for the first voiced frame, T(i−2), and the other for the second voiced frame, T(i−1). These two tests are performed during successive frames. The purpose of the voice segment test is to reduce the probability of defining the start-up of a voiced region when such a region is not actually begun. This is important since the only other consistency tests for the voice regions are performed in the maximum breathing and pitch doubling tests and there only one consistency condition is required. The first consistency test is performed to assure that the distance of the right candidate sample in T(i−2) and the most left candidate sample in T(i−1) and T(i−2) are close to within a pitch threshold B+2.

If the first consistency test is met, then the second consistency test is performed during the next frame to ensure exactly the same result that the first consistency test ensured but now the frame sequence has been shifted by one to the right in the sequence of frames. If the second consistency test is not met, then T(i−1) is set to zero, implying that frame i−1 can not be the second voiced frame (if T(i−2) was not set to zero). However, if both of the consistency tests are passed, then frames i−2 and i−1 define a start-up of a voiced region. If T(i−1) is set to zero, while T(i−2) was determined to be non-zero and T(i−3) is zero, which indicates that frame i−2 is voiced between two unvoiced frames, the abrupt change test takes care of this situation and this particular test is described later.

The maximum breathing and pitch doubling test assures pitch consistency over two adjacent voiced frames in a voiced region. Hence, this test is performed only if T(i−3), T(i−2), and T(i−1) are non-zero. The maximum breathing and pitch doubling tests also checks and corrects any pitch doubling errors made by the distance detector 202. The pitch doubling portion of the check checks if T(i−2) and T(i−1) are consistent or if T(i−2) is consistent with twice T(i−1), implying a pitch doubling error. This test first checks to see if the maximum breathing portion of the test is met, that is done by $$|T(i-2) - T(i-1)| \leqq A,$$

where A may advantageously have the value 10. If the above equation is met, then T(i−1) is a good estimate of the pitch distance and need not be modified. However, if the maximum breathing portion of the test fails, then the test must be performed to determine if the pitch doubling portion of the test is met. The first part of the test checks to see if T(i−2) and twice T(i−1) meet the following condition, given that T(i−3) is non-zero, $$|T(i-2) - 2T(i-1)| \leqq \frac{T(i-1)}{2}.$$

If the above condition is met, then T(i−1) is set equal to T(i−2). If the above condition is not met, then T(i−1) is set equal to zero. The second part of this portion of the test is performed if T(i−3) is equal to zero. If the following are met $$|T(i-2) - 2T(i-1)| \leqq B$$

and $$|T(i-1) - T(i)| > A$$

then $$T(i-1) = T(i-2).$$

If the above conditions are not met, T(i−1) is set equal to zero.

The limiting test which is performed on T(i−1) assures that the pitch that has been calculated is within the range of human speech which is 50 Hz to 400 Hz. If the calculated pitch does not fall within this range, then T(i−1) is set equal to zero indicating that frame i−1 cannot be voiced with the calculated pitch.

The abrupt change test is performed after the three previous tests have been performed and is intended to determine that the other tests may have allowed a frame to be designated as voiced in the middle of an unvoiced region or unvoiced in the middle of a voiced region. Since humans usually cannot produce such sequences of speech frames, the abrupt change test assures that any voiced or unvoiced segments are at least two frames long by eliminating any sequence that is voiced-unvoiced-voiced or unvoiced-voiced-unvoiced. The abrupt change test consists of two separate procedures each designed to detect the two previously mentioned sequences. Once pitch tracker 203 has performed the previously described four tests, it outputs T*(i−2) to the pitch voter 111 of FIG. 1. Pitch tracker 203 retains the other pitch distances for calculation on the next received pitch distance from distance detector 202.

Figure 4:
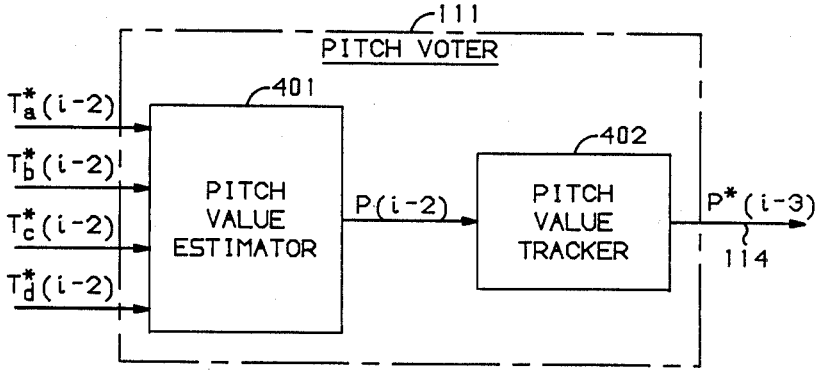
FIG. 4 illustrates, in block diagram form, pitch voter 111 of FIG. 1.

FIG. 4 illustrates in greater detail pitch voter 111 of FIG. 1. Pitch value estimator 401 is responsive to the outputs of pitch detectors 107 through 110 to make an initial estimate of what the pitch is for two frames earlier, P(i−2), and pitch value tracker 402 is responsive to the output of pitch value estimator 401 to constrain the final pitch value for the third previous frame, P(i−3), to be consistent from frame to frame.

Consider now, in greater detail, the functions performed by pitch value estimator 401. In general, if all of the four pitch distance estimates values received by pitch value estimator 401 are non-zero, indicatiing a voiced frame, then the lowest and highest estimates are discarded, and P(i−2) is set equal to the arithmetic average of the two remaining estimates. Similarly, if three of the pitch distance estimate values are non-zero, the highest and lowest estimates are discarded, and pitch value estimator 401 sets P(i−2) equal to the remaining non-zero estimate. If only two of the estimates are non-zero, pitch value estimator 401 sets P(i−2) equal to the arithmetic average of the two pitch distance estimated values only if the two values are close to within the pitch threshold A. If the two values are not close to within the pitch threshold A, then pitch value estimator 401 sets P(i−2) equal to zero. This determination indicates that frame i−2 is unvoiced, although some individual detectors determined, incorrectly, some periodicity. If only one of the four pitch distance estimate values is non-zero, pitch value estimator 401 sets P(i−2) equal to the non-zero value. In this case, it is left to pitch value tracker 402 to check the validity of this pitch distance estimate value so as to make it consistent with the previous pitch estimate. If all of the pitch distance estimate values are equal to zero, then, pitch value estimator 401 sets P(i−2) equal to zero.

Pitch value tracker 402 is now considered in greater detail. Pitch value tracker 402 is responsive to the output of pitch value estimator 401 to produce a pitch value estimate for the third previous frame, P*(i−3), and makes this estimate based on P(i−2) and P(i−4). The pitch value P*(i−3) is chosen so as to be consistent from frame to frame.

The first thing checked is a sequence of frames having the form: voiced-unvoiced-voiced, unvoiced-voiced-unvoiced, or voiced-voiced-unvoiced. If the first sequence occurs as is indicated by P(i−4) and P(i−2) being non-zero and P(i−3) is zero, then the final pitch value, P*(i−3), is set equal to the arithmetic average of P(i−4) and P(i−2) by pitch value tracker 402. If the second sequence occurs, then the final pitch value, P*(i−3), is set equal to zero. With respect to the third sequence, the latter pitch tracker is responsive to P(i−4) and P(i−3) being non-zero and P(i−2) being zero to set P*(i−3) to the arithmetic average of P(i−3) and P(i−4), as long as P(i−3) and P(i−4) are close to within the pitch threshold A. Pitch tracker 402 is responsive to $$|P(i-4)-P(i-3)| \leqq A,$$

to perform the following operation $$P^*(i-3) = \frac{P(i-4)+P(i-3)}{2}.$$

if pitch value tracker 402 determines that P(i−3) and P(i−4) do not meet the above condition (that is, they are not close to within the pitch threshold A), then, pitch value tracker 402 sets P*(i−3) equal to the value of P(i−4).

In addition to the previously described operations, pitch value tracker 402 also performs operations designed to smooth the pitch value estimates for certain types of voiced-voiced-voiced frame sequences. Three types of frame sequences occur where these smoothing operations are performed. The first sequence is when the following is true $$|P(i-4)-P(i-2)| \leqq A,$$

and $$|P(i-4)-P(i-3)| > A.$$

When the above conditions are true, pitch value tracker 402 performs a smoothing operation by setting $$P^*(i-3) = \frac{P(i-4)+P(i-2)}{2}.$$

The second set of conditions occurs when $$|P(i-4)-P(i-2)| > A,$$

and $$|P(i-4)-P(i-3)| \leqq A.$$

When this second set of conditions is true, pitch value tracker 402 sets $$P^*(i-3) = \frac{P(i-4)+P(i-3)}{2}.$$

The third and final set of conditions is defined as $$P(i-4)-P(i-2)| > A,$$

and $$|P(i-4)-P(i-3)| > A.$$

For this final set of conditions occur, pitch value tracker 402 sets $$P^*(i-3)=P(i-4).$$

Figure 5:
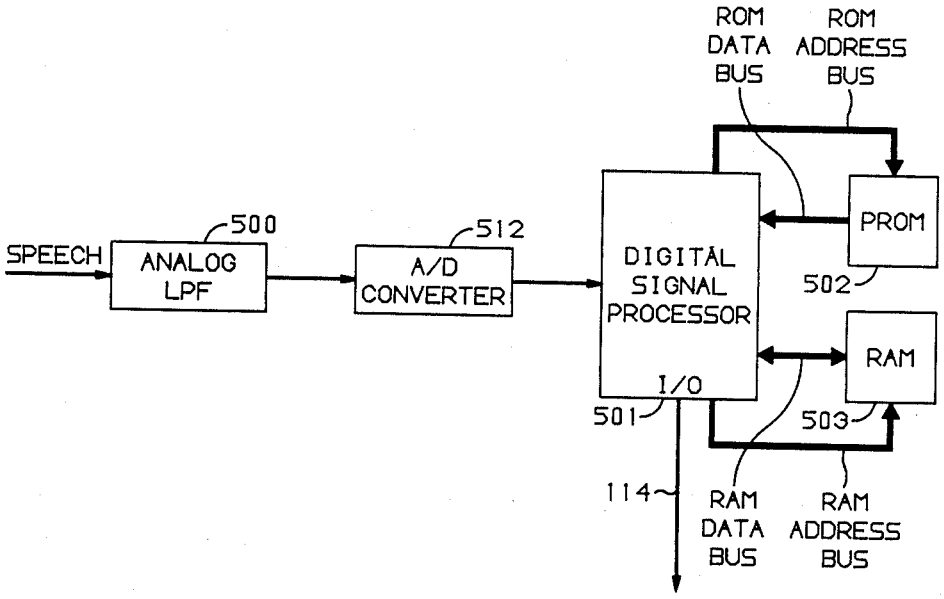
FIG. 5 illustrates a digital signal processor implementation of FIG. 1.

FIG. 5 illustrates an implementation of the blocks of FIG. 1 utilizing a digital signal processor that may advantageously be a Texas Instruments' TMS320-20 digital signal processor. The latter processor along with PROM memory 502 and RAM memory 503 implements blocks 102 through 111 of FIG. 1. The program stored in PROM 502 for implementing the aforementioned elements of FIG. 1 is similar to the C source code program detailed in Appendix A. The program of Appendix A is intended for execution on a Digital Equipment Corp.'s VAX 11/780-5 computer system with suitable digital-to-analog and analog-to-digital converter peripherals or a similar system. The pitch detectors 107 through 110 of FIG. 1 are implemented by common code that utilizes separate data storage areas for each pitch detector in RAM 503. The details given of FIG. 1 in FIGS. 2 and 4 are implemented by sets of program instructions stored within PROM 502. Each set of program instructions can be further subdivided into subsets and groups of programmed instructions.

It is to be understood that the above-described embodiment is merely illustrative of the principles of the invention and that other arrangements may be devised by those skilled in the art without departing from the spirit and scope of the invention.

APPENDIX A

```
/* EMACS_MODES: !c, tabstop=4 */
/* For more comments on the pitch detector look in /vi/dp/pitch/tone.c  */
/*      *  File name : /vi/picone/librv/pitch/pdetpr.c
        *   This program represents the final pitch detector (7/14/83).
        *   The output of the program is a file with pitch contour.
        *
        *   To compile:
                cc pdetpr.c -lm -i -O -o pdetpr
        *
        *   To run:
                pdetpr speechin speechout
        *
*/

#include <stdio.h>
#include <math.h>
#define PMODE 0644

int step;
int SIL[5];
int s[15],sristers[6],d[15],dexia[6],dist[6],distd[6],distdd[6];
int pitch[6],r[6][190];
int F,L,T,k,y;
int AMPL[6];
int temp[6],torder[6],order[6],orderp[6],major;

double sqrt(),stepp;

float Rate,Nframes;

int counter,i,ss,unv[6],III,LL,N;

main(argc,argv)
int argc;
char *argv[];
{

float maxval[20],minval[20],bits[20],gain1;
double fabs(),log(),exp(),asin();

int sort();
int search();

float bdR[200],eR[200],extraR[15];
float stepR,stepdR;
int LASTP,out,outd,outdd,outddd;
int majord[2],CLOSE[2];
int CUNV[6],UNVTH;

float number,S1,S2,S3,R,RR;
float MAX,POWER[7],LOC[5],FIRSTL;
float coeff[10][15];

int j,m;
int pointer1,pointer2,nn[1];
int nnn[190];

/* Open input and output files */
if((pointer1=open(argv[1],0))== -1)
        {printf("Cannot open %s0,argv[1]);exit(1);}
if((pointer2=creat(argv[2],PMODE))== -1)
        {printf("Cannot open %s0,argv[2]);exit(1);}

/* Initialize unvoiced */
dist[0]=0;
dist[1]=0;
dist[2]=0;
dist[3]=0;
dist[4]=0;
outdd=0;
outddd=0;

/* Define parameters */
counter=1;          /*frame counter*/
L=160;              /*frame length in 8KHz samples*/
LL=L;
T=6;                /*position threshold*/
F=10; /*freq. threshold*/
N=10;               /*LPC filter order*/
UNVTH= -20;         /*Unvoiced threshold for coefficients */
SIL[0]=SIL[1]=100;
SIL[2]=SIL[3]=50;
k=1;

/* Begin analysis loop */
m=0;    /*inframe counter*/
while( read(pointer1,nn,2) == 2 )
{
        m=m+1;
        RR=eR[m+N-1]=bdR[m+N]=nn[0];

        /*load the signal+ and signal- buffers for pitch detection*/
        r[0][m-1]=nn[0];

        r[1][m-1]=r[0][m-1];
        if(r[0][m-1] > 0.0){r[0][m-1]=0.0;}
        else                {r[0][m-1]=abs(r[0][m-1]);}
        if(r[1][m-1] < 0.0){r[1][m-1]=0.0;}

        if( m >= LL-(N-1) ){extraR[m-(LL-N)]=RR;}
```

```
if( m%LL == 0)
        {
        /*Do LPC, inverse filter analytic signal using real coeffs*/
        for(j=1;j<=N;++j)
        {
        S1=0.0;S2=0.0;
        for(i=N;i<=LL+N-1;++i)
                {S1=S1+eR[i]*eR[i]+bdR[i]*bdR[i];S2=S2+eR[i]*bdR[i];}
        if(S1 == 0.0){coeff[1][j] =          0.0;}
        else                {coeff[1][j] = -2.0*S2/S1;}
        for(i=1;i<=LL+N-1;++i)
                {
                R=eR[i]+bdR[i]*coeff[1][j];
                stepR=bdR[i]+eR[i]*coeff[1][j];
                eR[i]=R;
                bdR[i]=stepdR;
                stepdR=stepR;
                }
        } /*j=1,N*/

/* Load unvoiced integer coeff. */
CUNV[1]=100.0*coeff[1][1];

/*load residue buffer for pitch detector*/
MAX=0.0;
POWER[1]=0.0;
for(i=1;i<=LL;++i)
        {
        POWER[1]=POWER[1]+eR[i+N-1]*eR[i+N-1];
        if(stepp>MAX) {MAX=stepp;LOC[1]=i;}
        r[2][i-1]=eR[i+N-1];
        r[3][i-1]=r[2][i-1];
        if(r[2][i-1] > 0.0){r[2][i-1]=0.0;}
        else                {r[2][i-1]= abs(r[2][i-1]);}
        if(r[3][i-1] < 0.0){r[3][i-1]=0.0;}
        }

bdR[1]=extraR[1];
for(i=1;i<=N-1;++i)
        {eR[i]=bdR[i+1]=extraR[i+1];}

/* Do pitch detection */
III=0;
search();
III=1;
search();
III=2;
search();
III=3;
search();

/*Define "T" for the gate*/
if(outd==0) T=6;
else if(outd<28) T=4;
else if(outd<60) T=5;
else if(outd<90) T=6;
else T=7;
/* Form pitch decision */
if(counter>2)
        {

        /* Call sort for distd[] */
        for(i=0;i<=3;i=i+1){temp[i]=distd[i];}
        sort();
        for(i=0;i<=3;i=i+1){order[i]=torder[i];}

        /* Check if major>=2 and if 2 or more are close */
        majord[0]=major;
        if(major >= 2)
                {
                if      ( abs(order[0]-order[1])<T )
                        {CLOSE[0]=order[1];}
/*DPP - added 5/30/84: major>2 &&--since order[2] implies a major>=3
   OR major>2*/
                else if( major>2 && abs(order[1]-order[2])<T )
                        {CLOSE[0]=order[1];}
                else
                        {CLOSE[0]=0;}
                }
        else
                {CLOSE[0]=0;}

        /* Choose majority pitch */
        if      (major > 2)
                        {out=order[1];}
else if(major == 1)
                {
        /* Check if unvoiced due to coeff[1][1] */
        if(CUNV[3] > UNVTH){out=0;}
        else                {out=order[0];}
                }

else if(major == 2)
                {
        /* Check if unvoiced due to coeff[1][1] */
        if( (abs(order[0]-order[1])>T) && (CUNV[3] > UNVTH) ){out=0;}

                /* Check if two pitches are close together */
                else if      ( abs(order[0]-order[1]) < (order[1]>>2) )
                        {out = (order[0] + order[1])>>1;}

        /* If previous valid pitch !=0 , choose closest */
                else if(outdd != 0)
                        {
                        if(abs(order[0]-outdd) < abs(order[1]-outdd))
                                {out = order[0];}
                        else
                                {out = order[1];}
                        }

                /* If previous valid pitch = 0 , look ahead */
                else
                        {/* look ahead */

                        /* Sort dist[] */
                        for(i=0;i<=3;i=i+1){temp[i]=dist[i];}
                        sort();
                        for(i=0;i<=3;i=i+1){orderp[i]=torder[i];}
```

```
                                /* If major=1, choose closest */
                                if(major == 1)
                                        {
                                        if(abs(order[0]-orderp[0])<abs(order[1]-orderp[0]))
                                                {out=order[0];}
                                        else
                                                {out=order[1];}
                                        }

                                /* If major>2, choose closest to orderp[1] */
                                else if(major>2)
                                        {
                                        if( (abs(order[0]-orderp[1])) < (abs(order[1]-orderp[1])) )
                                                {out=order[0];}
                                        else
                                                {out=order[1];}
                                        }

                                /* If major=2, */
                                else if(major == 2)
                                        {
                                        /* If orderp[] are close choose closest */
                                        if( abs(orderp[0]-orderp[1]) < (orderp[1]>>2) )
                                                {
                                                if(abs(order[0]-orderp[0]) > abs(order[1]-orderp[0]))
                                                        {out=order[1];}
                                                else
                                                        {out=order[0];}
                                                }

                                        /* Otherwise, pick order[] closest to LASTP */
                                        else
                                                {
                                                if(abs(order[0]-LASTP) < abs(order[1]-LASTP))
                                                        {out=order[0];}
                                                else
                                                        {out=order[1];}
                                                }
                                        }/*major==2*/

else out=0;

                                }/* look ahead */

                        }/*major == 2*/

        else
                {out=0;}

if(counter>3)
        {

        /* Search dist[] */
        for(i=0;i<=3;i=i+1){temp[i]=dist[i];}
        sort();
        for(i=0;i<=3;i=i+1){order[i]=torder[i];}

        /* If pitch is much different from order[1],
            and its a startup, set outd=order[1] */
        if((outd!=0) && ((outddd==0)||(outdd==0)) && (major>2) && (abs(outd-order[1])>F))
                {outd=order[1];}

        /* Check any uvv sequence */
        if( (outdd==0) && (outd!=0) && (out!=0) )
                {

                /* Check startup for energy differential */
                /*if((majord[1]<3) && (POWER[5]!=0.0) && ((POWER[4]/POWER[5])<1.15))
                        {outd=0.0;}

                else
                        {
*/
                        step=abs(outd-out);
                        if((step > F) && (major > 2)){outd=order[1];}
                        else if(step > F)               {outd=0;}
                        }


                /*}*/

        /* Check any vvu sequence */
        else if(outdd!=0 && outd!=0 && out==0 && (abs(outdd-outd) > F))
                {outd=outdd;}

        /* Smooth any vvv sequence */
        else if(outdd!=0 && outd!=0 && out!=0)
                {
                step=abs(out-outdd);
                if(step<=F)
                        {
                        step=abs(outd-outdd);
if(step>F && majord[1]<2 ) outd=(out+outdd)/2;
                        }
                else
                        {
                        if       (CLOSE[1]!=0)
                                {outd=CLOSE[1];}
                        else if(abs(outd-outdd)>F)
                                {outd=outdd;}
                        else
                                {outd=outd;}
                        }
                }

        /* Remove any vuv sequence */
        else if(outdd!=0 && outd==0 && out!=0){outd=outdd;}

        /* Remove any uvu sequence */
        else if(outdd==0 && outd!=0 && out==0){outd=0;}

        /* Write out pitch and store last non-zero pitch */
        if(outd != 0){LASTP=outd;}
        for(i=0;i<=LL-1;i=i+1){nnn[i]=outd;}
        write(pointer2,nnn,2*L);
printf("frame %3d:  %5d  %5d  %5d  %5d  pitch = %5d0,counter-3,distdd[0],distdd[1],distdd[2],distdd[3],outd);

        } /*counter>3 */
```

```
/* Shift down */
outddd=outdd;
outdd=outd;
outd=out;
for(i=0;i<=3;++i)
        {distdd[i]=distd[i];distd[i]=dist[i];}

} /*counter>2 */

m=0;
counter=counter+1;

for(j=4;j>1;j=j-1)
        {
        for(i=1;i<=N;++i){coeff[j][i]=coeff[j-1][i];}
        AMPL[j]=AMPL[j-1];
        CUNV[j]=CUNV[j-1];
    LOC[j]=LOC[j-1];
        }
for(j=5;j>1;j=j-1){POWER[j]=POWER[j-1];}
CLOSE[1]=CLOSE[0];
majord[1]=majord[0];

   }
  }
}

sort()
{
int min1;
int i,j,jmin1;

        /* Order and count how many non-zero */
        major=0;jmin1=0;
        for(i=0;i<=3;i=i+1)
                {
                min1=999;
                for(j=0;j<=3;j=j+1)
                        {
                        if((temp[j] != 0) && (temp[j] <= min1))
                                {min1=temp[j];jmin1=j;}
                        }

                torder[i] = min1;
                if(min1 != 999){major = major + 1;}
                temp[jmin1] = 999;
                }

}

int search()
{
        int n,j,M,mleft,mright,s,abs(),new,p;
        int FLEFT,FRIGHT;

        int A[15],D[15],max,min,aa,x,aaa,bbb,general();
        int proj;

        /* Make T and F adaptive to pitch */
        if(distd[III]==0) T=6;
        else if(distd[III]<28) T=4;
        else if(distd[III]<60) T=5;
        else if(distd[III]<90) T=6;
        else T=7;

        n=1;
        while(n>0){
                a[n]=A[n]=0; /*init max for the frame*/
                for(i=0;i<L;++i){
                        if(r[III][i]>A[n]){
                                a[n]=A[n]=r[III][i];
                                d[n]=D[n]=i;
                        }
                }
                if(A[n]==0) break;
if(A[n]<(A[1]>>2)) break;/*A[1]*0.25*/
                max=D[n]+18;
                if(max>=L) max=L-1;
                min=D[n]-18;
                if(min<0) min=0;
                for(i=min;i<=max;++i) r[III][i]=0;
                n=n+1;
        }
        if((III == 0) || (III == 1)){AMPL[1]=A[1];}
        for(i=1;i<n-1;++i){
                for(j=1;j<n-1;++j){
                        if(d[j]>d[j+1]){
                                step=d[j];
                                d[j]=d[j+1];
                                d[j+1]=step;
                                step=a[j];
                                a[j]=a[j+1];
                                a[j+1]=step;
                        }
                }
        }
        for(i=1;i<n;++i) if(a[i]==A[1]) {ss=i; break;}

/* Check for secondary pulses */
if( n-1 > 2)
{
  for(j=ss-2;j>=1;j=j-1)
    {
    for(i=ss-1;i>j;i=i-1)
      {
      if( (a[ss]-a[j])<200){proj=(a[ss]-a[j])*(d[i]-d[j])/(d[ss]-d[j]);}
      else                  {proj=(a[ss]-a[j])/(d[ss]-d[j])*(d[i]-d[j]);}
      if(a[i] < ( ((proj+a[j])>>1) + ((proj+a[j])>>2) ))
        {
            a[i]=0;
            for(step=1;step<n;step=step+1){if(D[step]==d[i]){A[step]=0;}}
            }
      }
    }
  for(j=ss+2;j<=n-1;j=j+1)
    {
    for(i=ss+1;i<j;i=i+1)
      {
```

```
        if( (a[ss]-a[j])<200){proj=(a[ss]-a[j])*(d[i]-d[j])/(d[ss]-d[j]);}
        else          {proj=(a[ss]-a[j])/(d[ss]-d[j])*(d[i]-d[j]);}
        if(a[i] < (((proj+a[j])>>1) + ((proj+a[j])>>2)) )
                {
                a[i]=0;
                for(step=1;step<n;step=step+1){if(D[step]==d[i]){A[step]=0;}}
                }
        }
    }
}

if((n-1)==0) goto noth;
/*make frame adaptive to the END candidates*/
for(i=1;i<n;++i){if(a[i]!=0){FLEFT=d[i]-T;break;}}
for(i=n-1;i>=1;i=i-1){if(a[i]!=0){FRIGHT=d[i]+T;break;}}

        M=0;
left:
        i=ss;
again:
        k=1;
        i=i-1;
        if(i<1){
                mleft=ss;
                goto right;
        }
        aa=d[ss]-d[i];
        p=i-1;
        x=d[i]-aa;
if(a[i] < ((a[ss]>>1) + (a[ss]>>5) - (a[ss]>>3)) ) goto again;/*a[ss]0.4*/
back:
        if(p<1 || x< FLEFT) {
                mleft=p+1;
                goto right1;
        }
        if(x>d[p]+T) goto again;
bas:
        step=x-d[p];
        if(abs(step)>T){
                M=0;
                p=p-1;
                if(p<1 || x>d[p]+T) goto again;
                else goto bas;
        }
        y=d[ss]-d[p];
        M=1;
        k=k+1;
        x=d[p]-aa;
        p=p-1;
        goto back;
right1:
        new=0;
        p=ss+1;
        x=d[ss]+aa;
back1:
        if(p>n-1 || x>FRIGHT) {
                if(M==0) goto right;
                else{
                        mright=p-1;
                        goto many;
                }
        }
        if(x<d[p]-T) goto again;
ba:
        step=x-d[p];
        if(abs(step)>T){
                M=0;
                p=p+1;
                if(p>n-1 || x<d[p]-T) goto again;
                else goto ba;
        }
if(a[p] < ((a[ss]>>1)+(a[ss]>>5)-(a[ss]>>3)) && new==0) goto again;
        new=new+1;
        y=d[p]-d[mleft];
        M=1;
        k=k+1;
        x=d[p]+aa;
        p=p+1;
        goto back1;
right:
        i=ss;
againn:
        k=1;
        i=i+1;
        if(i>n-1){
                mright=ss;
                goto fin;
        }
        aa=d[i]-d[ss];
        p=i+1;
        x=d[i]+aa;
if( a[i] < ((a[ss]>>1)+(a[ss]>>5)-(a[ss]>>3)) ) goto againn;
backk:
        if(p>n-1 || x>FRIGHT){
                mright=p-1;
                goto left1;
        }
        if(x<d[p]-T) goto againn;
bass:
        step=x-d[p];
        if(abs(step)>T){
                M=0;
                p=p+1;
                if(p>n-1 || x<d[p]-T) goto
                againn;
                else goto bass;
        }
        y=d[p]-d[ss];
        M=1;
        k=k+1;
        x=d[p]+aa;
        p=p+1;
        goto backk;
left1:
        new=0;
        p=ss-1;
        x=d[ss]-aa;
backk1:
```

```
        if(p<1 || x< FLEFT){
                if(M==0) goto fin;
                else{
                        mleft=p+1;
                        goto many;
                }
        }
        if(x>d[p]+T) goto againn;
basss:
        step=x-d[p];
        if(abs(step)>T){
                M=0;
                p=p-1;
                if(p<1 || x>d[p]+T) goto
                againn;
                else goto basss;
        }
if(a[p] < ((a[ss]>>1)+(a[ss]>>5)-(a[ss]>>3)) && new==0) goto againn;
        new=new+1;
        y=d[mright]-d[p];
        M=1;
        k=k+1;
        x=d[p]-aa;
        p=p-1;
        goto backk1;
fin:
        s=1;
saxia:
        s=s+1;
        if(s>n-1) goto one;
        aa=d[ss]-D[s];
        if(aa<0) aa= -aa;
        if(d[ss]>D[s]){
                aaa=d[ss]+aa;
                bbb=D[s]-aa;
                mright=ss;
                for(i=1;i<n;++i) if(d[i]==D[s]) {mleft=i; break;}
                goto common;
        }
        aaa=D[s]+aa;
        bbb=d[ss]-aa;
        for(i=1;i<n;++i) if(d[i]==D[s]) {mright=i; break;}
        mleft=ss;
common:
        y=d[mright]-d[mleft];
        step=y-dist[III];
        if(step<0) step= -step;
        if(dist[III]!=0 && step>F) goto saxia;
        /*for secondary pulses in case of two*/
        /* Use variable END point on the LEFT to accommodate   */
        /* start-up voiced--do it only if previous is Unvoiced */
        if(dist[III]==0){if(aaa<(L-T) || bbb>=(FLEFT+(T<<1))){goto saxia;}}
        else            {if(aaa<L-T || bbb>=T){goto saxia;}}
if(A[s] < ((a[ss]>>1)+(a[ss]>>5)-(a[ss]>>3)) ) goto saxia;
        k=1;
        goto many;
noth:
k=1;
       dist[III]=general();
       pitch[III]=0;
       goto returna;
one:
        if(counter!=1){
                aristera[III]=d[ss];
                dist[III]=general();
        }
        pitch[III]=d[ss]-dexia[III]+L;
        dexia[III]=d[ss];
        goto returna;
many:
        if(counter!=1) {
                aristera[III]=d[mleft];
                dist[III]=general();
        }
        dexia[III]=d[mright];
        pitch[III]=y/k;
returna:
        if(counter==1) distd[III]=dist[III];
        if(counter==2) {
                distdd[III]=distd[III];
                distd[III]=dist[III];
        }
        if(counter>2){
                if(distdd[III]==0 && dist[III]==0) if(distd[III]!=0) distd[III]=0;
                if(distdd[III]!=0 && dist[III]!=0) if(distd[III]==0) {
                        step=dist[III]-distdd[III];
                        if(abs(step)<(F<<1)) distd[III]=(distdd[III]+dist[III])>>1;
                }
        }

}
int general(){
        int gen;
        if(dist[III]==0){
                unv[III]=1;
                step=dexia[III]+pitch[III]-aristera[III]-L;
                if(L-dexia[III]+aristera[III]<20 ) step=step-y/k;/*for split pulse*/
                if(step<0) step= -step;
if(step<=T+2) goto voiced;
                else goto unvoiced;
}
        if(unv[III]==0){
                step=dexia[III]+pitch[III]-aristera[III]-L;
                if(L-dexia[III]+aristera[III]<20 ) step=step-y/k;
                if(step<0) step= -step;
                if(step<=T+2)goto next;
                else goto unvoiced;
        }
next:
step=abs(pitch[III]-dist[III]);
if(step<=F) goto voiced;
step=abs((pitch[III]<<1) -dist[III]);
if(distdd[III]!=0){
if(step<=(pitch[III]>>1)) goto raise;
else goto unvoiced;
}
else{
```

```
if(step<=T){
if(abs(pitch[III]-y/k)>F) goto raise;
else goto voiced;}
else goto unvoiced;}
raise: pitch[III]=distd[III];
voiced:
        if(pitch[III]<20 || pitch[III]>250) goto unvoiced;
        if(s[ss]<SIL[III]) goto unvoiced;
        gen=pitch[III];
        unv[III]=unv[III]-1;
        return(gen);
unvoiced:
        gen=0;
        return(gen);
}
```

What is claimed is:

1. A pitch detector system for human speech comprising:

means for storing a predetermined number of evenly spaced samples of instantaneous amplitude of said speech as a speech frame;

means for generating residual samples from said speech samples;

a plurality of identical means each responsive to an individual predetemined portion of said residual samples of said frame for estimating a pitch value of said frame;

another plurality of identical means each responsive to an individual predetermined portion of said speech samples of said frame for estimating a pitch value of said frame;

means for calculating a final pitch value from the estimated pitch values from each of said plurality and said other plurality of estimating means wherein an unvoiced speech frame is indicated by said calculated pitch value being equal to a predefined value and a voiced frame is indicated by said calculated pitch value being equal to a value other than said predefined value;

said calculating means comprises means responsive to all of said estimated pitch values having a value different than said predefined value for setting said calculated pitch value equal to the arithmetic average of a subset of said estimated pitch values, said subset comprising all of said estimated pitch values except the lowest magnitude value and the highest magnitude value;

means for constraining said final pitch value so that the calculated pitch value is consistent with calculated pitch values from previous frames;

said constraining means comprises means responsive to a first sequence of frames comprising a voiced frame and an unvoiced frame and a second voiced frame for generating a new calculated pitch value having an arithmetic relationship to the calculated pitch values of the frames of said first sequence;

said generating means comprises a new pitch value generating means responsive to a second sequence of frames comprising an unvoiced frame and a voiced frame and a second unvoiced frame for generating a new calculated value indicating an unvoiced frame; and said new pitch value generating means further reponsive to a third sequence of frames comprising a voiced frame and a second voiced frame and a third voiced frame for generating a new calculated pitch value having an arithmetic relationship to the calculated pitch values of the frames of said third sequence.

2. The system of claim 1 wherein said generating means responsive to said first sequence comprises means for setting the new calculated pitch value equal to the arithmetic average of the calculated pitch values of the voiced frames of said first sequence; and said generating means further comprises means responsive to said second sequence of frames for setting the new calculated pitch value equal to said predefined value.

3. The system of claim 2 wherein said new pitch value generating means further comprises means responsive to a fourth sequence of frames comprising a first voiced frame and a second voiced frame and an unvoiced frame for setting the new calculated pitch value equal to the average of the calculated pitch values for the voiced frames and the unvoiced frame upon the magnitude of the difference between the calculated pitch values of the two voiced frames being less than another predefined value; and means responsive to said fourth sequence for setting the new calculated pitch value equal to the pitch value of the first voiced frame upon the magnitude of the difference between the calculated pitch values for the two voiced frames being greater than said other predefined value.

4. The system of claim 1 wherein said setting means further responsive to said estimated pitch values upon all but a first subset of said estimated pitch values equaling said predefined value for setting said calculated pitch value equal to the arithmetic average of said first subset upon the estimated pitch values of said first subset of said pitch values differing by less than another predefined value from each other; and said setting means further responsive to all of said estimated pitch values being equal to said predefined value except for a second subset of said estimated pitch values for setting said calculated pitch value equal to said predefined value upon said estimated pitch values of said second subset differing from each other by a magnitude greater than said other predefined value.

5. The system of claim 4 wherein said setting means further responsive to all but one of said estimated pitch values equaling said predefined value for setting said calculated pitch value equal to the one of said estimated pitch values not equal to said predefined value.

6. A pitch detector for human speech comprising:

means for storing a predetermined number of evenly spaced speech samples of instantaneous amplitude of said speech as a present speech frame;

means for filtering said samples to produce residual samples of the speech remaining after the formant effects of the vocal tract have been substantially removed;

first means responsive to positive valued ones of said speech samples for estimating a first pitch value of said present speech frame;

second means responsive to negative valued ones of said speech samples for estimating a second pitch value of said present speech frame;

third means responsive to positive valued ones of said residual samples for estimating a third pitch value of said present speech frame;

a fourth means responsive to negative valued ones of said residual samples for estimating a fourth pitch value of said present speech frame;

means for calculating a pitch value from the estimated pitch values from said first, second, third and fourth estimating means wherein an unvoiced speech frame is indicated by said calculated pitch value being equal to a predefined value and a voiced frame is indicated by said calculated pitch value being equal to a value other than said predefined value;

said calculating means comprises means responsive to all of said estimated pitch values having a value different than said predefined value for setting said calculated pitch value equal to the arithmetic average of a subset of said estimated pitch values, said subset comprising all of said estimated pitch values except the lowest magnitude value and the highest magnitude value;

means for constraining said final pitch value so that the calculated pitch value is consistent with calculated pitch values from previous frames;

said constraining means comprises means responsive to a first sequence of frames comprising a voiced frame and an unvoiced frame and a second voiced frame for generating a new calculated pitch value having an arithmetic relationship to the calculated pitch values of the frames of said first sequence;

means responsive to a second sequence of frames comprising an unvoiced frame and voiced frame and a second unvoiced frame for generating a new calculated value indicating an unvoiced frame; and said generating means further responsive to a third sequence of frames comprising a voiced frame and a second voiced frame and a third voiced frame for generating a new calculated pitch value having an arithmetic relationship to the calculated pitch values of the frames of said third sequence.

7. The system of claim 6 wherein said generating means responsive to said first sequence comprises means for setting the new calculated pitch value equal to the arithmetic average of the calculated pitch values of the voiced frames of said first sequence; and said generating means further responsive to said second sequence of unvoiced and voiced and unvoiced frames for setting the new calculated pitch value to said predefined value.

8. The system of claim 7 wherein said generating means further comprises means responsive to a fourth sequence of frames comprising a first voiced frame and second voiced frame and an unvoiced frame for setting the new calculated pitch value equal to the average of the calculated pitch values for the voiced frames and the unvoiced frame upon the magnitude of the difference between the calculated pitch values of the two voiced frames being less than another predefined value; and means responsive to said fourth sequence for setting the new calculated pitch value equal to the pitch value of said first voiced frame upon the magnitude of difference between the calculated pitch values for the two voiced frames being greater than said other predefined value.

9. The system of claim 6 wherein said setting means further responsive to said estimated pitch values upon all but a first subset of said estimated pitch values equaling said predefined value for setting said calculated pitch value equal to the arithmetic average of said first subset upon the estimated pitch values of said first subset of said pitch values differing by less than another predefined value from each other; and said setting means further responsive to all of said estimated pitch values being equal to said predefined value except for a second subset of said estimated pitch values for setting said calculated pitch value equal to said predefined value upon said estimated pitch values of said second subset differing from each other by magnitude greater than said other predefined value.

10. The system of claim 9 wherein said setting means further comprises means responsive to all but one of said estimated pitch values equaling said predefined value for setting said calculated pitch value equal to the one of said estimated pitch value not equal to said predefined value.

11. A method for detecting the pitch of human speech with a system comprising a quantizer for converting the speech into frames of digital samples and a digital signal processor responsive to a plurality of program instructions and said frames of digital samples to determine the pitch of the speech, said method comprising the steps of:

producing residual samples of the digitized speech that remain after the formant effects of the vocal track have been substantially removed;

estimating a first pitch value of a present speech frame in response to positive valued ones of said digitized speech samples;

estimating a second pitch value of said present speech frame in response to negative valued ones of said digitized speech samples;

estimating a third pitch value of said present speech frame in response to positive valued ones of said residual samples; and estimating a fourth pitch value of said present speech frame in response to negative valued ones of said residual samples; and calculating said final pitch value from said first, second, third, and fourth pitch values wherein an unvoiced speech frame is indicated by said calculated pitch value being equal to a predefined value and a voiced frame is indicated by said calculated pitch value being equal to a value other than said predefined value;

said step of calculating comprises the step of setting said calculated pitch value equal to the arithmetic average of a subset of said estimated pitch values, said subset comprising all of said estimated pitch values except the lowest magnitude value and the highest magnitude value;

constraining said final pitch value so that said final pitch value is in agreement with final pitch values from previous frames by;

said step constraining comprises the steps of generating a new calculated pitch value having an arithmetic relationship to the calculated pitch values of a first sequence of frames comprising a voiced frame and unvoiced frame and a second voiced frame;

generating a new calculated value indicating an unvoiced frame in response to a second sequence of frames comprising an unvoiced frame and a voiced frame and a second unvoiced frame; and generating a new calculated pitch value having an arithmetic relationship to the calculated pitch values of the frames of a third sequence of frames comprising a voiced frame and a second voiced frame and a third voiced frame.

12. The method of claim 11 wherein said step of generating a new calculated value in response to said first sequence comprises the step of setting the new calculated pitch value equal to the arithmetic average of the calculated pitch values of the voiced frames of said first sequence; and said step of generating a new calculated value for said second sequence comprises the step of setting the new calculated pitch value of said second sequence equal to said predefined value.

13. The method of claim 12 wherein said constraining step further comprises the step of generating in response to a fourth sequence of frames comprising a first voiced frame and a second voiced frame and an unvoiced frame a new calculated pitch value equal to the average of the calculated pitch values for the two voiced frames and the unvoiced frame upon the magnitude of the difference between the voiced frames being less than another predefined value; and said generating step further generating a new calculated pitch value equal to the pitch value of the first voiced frame upon the difference in magnitude between the two pitch values for the two voiced frames being greater than said other predefined value.

* * * * *